US005943843A

United States Patent [19]

Scholzke et al.

[11] Patent Number: 5,943,843

[45] Date of Patent: Aug. 31, 1999

[54] DEVICE AND METHOD FOR PACKAGING A MATERIAL WEB ROLL

[75] Inventors: Volker Scholzke, Krefeld; Jakob Hannen, Willich, both of Germany; Jozef-Franc Zajec, Velden, Netherlands; Hans-Josef Peters, Kleve, Germany; Udo Ticheloven, Wesel, Germany; Frank Rostek, Meerbusch, Germany

[73] Assignee: Voith Sulzer Finishing GmbH, Krefeld, Germany

[21] Appl. No.: 08/991,652

[22] Filed: Dec. 16, 1997

[30] Foreign Application Priority Data

Dec. 17, 1996 [DE] Germany ..... 196 52 450

[51] Int. Cl.[6] ..... B65B 11/04; B65B 57/00

[52] U.S. Cl. ..... 53/410; 53/136.2; 53/211; 53/465

[58] Field of Search ..... 53/465, 461, 416, 53/415, 410, 211, 214, 136.2, 139.5

[56] References Cited

U.S. PATENT DOCUMENTS

| | | | |
|---|---|---|---|
| 2,674,074 | 4/1954 | Lancast.er et al. | 53/136.2 |
| 2,872,767 | 2/1959 | Clem . | |
| 3,393,492 | 7/1968 | Lamon et al. . | |
| 3,828,523 | 8/1974 | Brenner et al. | 53/211 X |
| 4,840,008 | 6/1989 | Hood et al. | 53/211 X |
| 5,003,753 | 4/1991 | Dornblaser et al. | 53/136.2 X |
| 5,642,600 | 7/1997 | Hooper et al. | 53/136.2 X |
| 5,768,858 | 6/1998 | Hannen | 53/211 X |

FOREIGN PATENT DOCUMENTS

| | | |
|---|---|---|
| 1009556 | 5/1957 | Germany . |
| 1138682 | 10/1962 | Germany . |
| 1275440 | 8/1968 | Germany . |
| 19535746 | 4/1997 | Germany . |
| 1024945 | 4/1966 | United Kingdom . |
| 1429445 | 3/1976 | United Kingdom . |

OTHER PUBLICATIONS

Copy of German Office Action dated May 30, 1997 issued with DE App. No. 196 52 450.4–27. (No Translation).

Copy of a European Search Report dated Mar. 19, 1998. (No Translation).

*Primary Examiner*—James F. Coan

*Attorney, Agent, or Firm*—Greenblum & Bernstein, P.L.C.

[57] ABSTRACT

A device and method for packaging a web roll, having a longitudinal axis, with a packaging sheet. The device includes a packaging sheet dispenser which dispenses the packaging sheet to produce a body packaging by dispensing, on at least a portion of a longitudinal extent of the web roll, the packaging sheet. The packaging sheet dispenser is positioned to dispense the packaging sheet to form an acute angle between the lateral direction of the packaging sheet and the longitudinal axis. The packaging sheet dispenser is further arranged to dispense the packaging sheet to produce an end packaging having an axial projection on an end of the web roll. The packaging sheet dispenser is posited so that the lateral direction of the packaging sheet is substantially parallel to the longitudinal axis. During the production of the body packaging, the web roll migrates, which leads to problems in the subsequent placement of the face cover by the packing presses. To ease these problems, the packaging device further includes a packing press device that includes packing presses positioned to move parallel to the longitudinal axis. The packing presses are associated with end faces of the web roll and are independently positionable. The method includes forming an end packaging at a first end of the web roll that includes an axial projection, axially moving a packing plate toward the first end of the web roll, sensing the axial projection of the end packaging of the web roll, detecting placement of the packing plate relative to the axial projection, and pressing the packing plate against the first end of the web roll.

32 Claims, 2 Drawing Sheets

DEVICE AND METHOD FOR PACKAGING A MATERIAL WEB ROLL

CROSS-REFERENCE TO RELATED APPLICATION

The present application claims priority under 35 U.S.C. §119 of German Patent Application No. 196 52 450.4 filed Dec. 17, 1996, the disclosure of which is expressly incorporated by reference herein in its entirety.

BACKGROUND OF THE INVENTION

1. Field of the Invention

The invention relates to a device for packaging a web roll with a packaging sheet and a packaging sheet dispenser and a method for packaging a web roll.

2. Background of the Invention

A device of this type is known based on German Patent GB 1 429 445. The web roll is wrapped therein with a plastic sheet which is so flexible that folds which might be created during the wrapping process do not present a problem. There is no interruption between the production of the body packaging and the production of the end packaging. The packaging sheet remains in one piece.

After the web roll is wrapped, it is sent to a furnace where the plastic sheet is shrink-wrapped. The sheet also shrinks on the faces, thereby covering them.

The use of a plastic sheet, however, is not environmentally friendly and should, thus, be viewed critically.

From the post-published DE 195 35 746 A1, a device is known that packages a web roll with a packaging sheet that consists of packing paper. In this device, the body packaging is produced by first guiding the packaging sheet in a helical line around the web roll. The packaging sheet is then severed and, in separate steps, an end packaging on both axial ends of the web roll is produced. An inner face cover can be placed in the projection created by the end packaging, and the axial projection is then wrapped on the end packaging. An outer face cover can then be attached to the wrapped axial projection, by, for example a packing press.

This procedure, however, is accompanied by certain difficulties. In conventional packaging devices, which work with a packaging sheet matching the width of the web roll, the web roll is placed in the center of the packaging device. That is, the axial center of the web roll is located equidistant from the two packing presses. When, at the end of the packaging process, the packing presses are moved toward the web roll, they arrive at the faces simultaneously. Thus, the axial forces exerted by the packing presses on the web roll simultaneously counteract one another.

This procedure leads to considerable problems in making a body packaging by a packaging sheet guided in a helical line. Even when the web roll is positioned in the center, it has been observed, in many cases, that one of the two packing presses reaches the web roll sooner than the other. This may be caused by a combination of two circumstances which result from the manufacture of a body packaging with a helical packaging sheet. First, the web roll temporarily has a larger—albeit only slightly—diameter on one axial end than on the other. Second, a relatively great number of rotations of the web roll are required to manufacture this type of body packaging. This leads to an axial migration of the web roll in the direction of the larger diameter. This migration can easily be in the vicinity of one or several centimeters. As the packing press arrives, it pushes the packaging sheet toward the other packing press with its normal speed. Thus, when the packing press meets the other packing press, a collision at twice the speed results. This impact can easily lead to a tearing of the packaging. In addition, a considerable wear and tear on the motor-drive of the first packing press results, because it must accelerate the entire weight of the web roll.

SUMMARY OF THE INVENTION

The task of the present invention is to overcome the above noted defects and problems by reducing the stress on the device and the web roll during the manufacture of the packaging, i.e., when the web roll is being packaged.

This task is solved by a device and a method for packaging a web roll with a packaging sheet. The device includes a packaging sheet dispenser which dispenses the packaging sheet at an angle to its lateral direction to the axial direction of the web roll to produce a body packaging. The packaging sheet dispenser then dispenses the packaging sheet with its lateral direction parallel to the axial direction, thus creating an axial projection to make the end packaging.

The device further includes a packing press device which includes an axially movable packing press for each face of the web roll, whereby at least one packing press can be moved independently of the other packing press.

Both the new packing press device and the method compensate for the migration of the web roll. The web rolls, with which this invention is concerned, may be found, for example, in a paper factory, i.e., paper rolls. In textile factories there are also rolls in a comparable size range with sheets of textile wares wound around them. The axial length of the web roll may be in the vicinity of 0.5 to 3.8 m or even greater. The diameter of the web roll may be in the vicinity of 0.5 to 2.5 m. The width of the packaging sheet is greater than about 35 cm. Preferably, the width of the packaging sheet is approximately 50 cm. A multitude of web rolls of various widths can be packaged with a single packaging sheet width because the packaging sheet is guided around the web roll in a helical line to produce the body packaging. During the wrapping, the web roll leaves its centered position; that is, the distances of the faces of the web roll from the respective packing presses differ. However, because the two packing presses may be moved independently of each other, the movement of one packing press can be stopped as soon as it is in place on the web roll. Further movement of the web roll may be prevented so that the web roll does not have to be moved further. On the other side, the other packing press may also be brought into position on the face of the web roll. Thus, the web roll receives very gentle treatment, even though it has departed from its centered position. Further, wear and tear to the motor-drive of the packing press is also kept to a minimum.

In one embodiment of the invention, the device includes a sensor device that is designed to determine the axial position of the web roll, once the web roll is provided with a circumferential packaging. The circumferential packaging consists of the body packaging and the end packaging. With regard to the packing press, it is relatively insignificant where the web roll is positioned at the beginning of the packaging process. It is merely important that one can determine where the web roll is positioned when the packing presses go into action. The respective sensor device, which determines the position of the web roll, is provided for this purpose. The sensor device can send this information to the packing press motor-drives so that the packing presses can be moved in correlation thereto.

According to one aspect of the invention, the sensor device may be moved parallel to the axial direction of the web roll. The sensor device, thus, moves to the axial end of the web roll. The axial position of each face of the web roll can, therefore, be determined by the position of the sensor device.

Preferably, each packing press is assigned its own sensor device, which can be moved in tandem with the packing press. The packing press feels its way, so to speak, along each face of the web roll. Moving the sensor device in tandem with the packing press saves time, as the axial position of the web roll is determined immediately through the movement of the packing press.

According to one aspect of the invention, the sensor device may be arranged on the packing press, thereby eliminating the need for a separate motor-drive for the sensor device. A predetermined mechanical coupling already exists, thereby eliminating transmission errors caused by faulty determination of the coordination between the packing press and the sensor device.

The sensor device is advantageous in that it may exhibit a first sensor which detects the axial projection of the packaging sheet. As the name implies, the axial projection protrudes beyond the face by a slight amount. When the first sensor detects this projection, the packing press is also at a small distance from the face of the web roll. This can be used for braking purposes, so that the packing presses can actually be moved at a relatively high speed toward the faces. The axial projection does not, in fact, give any exact information as to the axial position of the web roll, except that it is in the vicinity or proximity of the face.

The first sensor may be designed as a light barrier so that the position of the axial projection or the web roll can be detected contact-free. Those sensors which work with light reflection also, for purposes of this application, fall under the term light barrier.

It may be particularly advantageous if the sensor device includes a second sensor to detect the placement of the packing press on the face of the web roll. As soon as the packing press is in place there, any further movement of the packing press must cease. Due to the axial projection of the end packaging, the placement of the packing press on the face can no longer be detected by the first sensor.

In accordance with one aspect of the invention, it may be advantageous to have the second sensor be designed as a pressure or tactile sensor. The sensor could, for example, be designed as an end switch that is actuated by the face. The necessary signal could also be triggered by the pressure applied by the face on the packing press. The pressure sensor could also be stored in the motor-drive strand of the packing press.

It may further be advantageous if a folding device, which acts on the axial projection of the end packaging, can be moved parallel to the axial direction of the web roll, which exhibits a position signal. The folding device wraps the axial projection of the end packaging on the face of the web roll. Because this wrapping must occur as close as possible to the face, the folding device is normally moved in the axial direction in a pressure-controlled manner as long as possible, that is, until the impeller wheels, for example, can still be rotated at reasonable cost or an axial movement still results when advance or feed pressure is applied. When the folding device can no longer be moved, the necessary information about the axial position of the respective face of the web roll has been obtained, so that the corresponding information can be gathered and evaluated by a simple position signal on the folding device.

Another way to state the invention is a device for packaging a web roll, having a longitudinal axis, with a packaging sheet that includes a packaging sheet dispenser to dispense the packaging sheet to produce a body packaging by dispensing on at least a portion of a longitudinal extent of the web roll. The packaging sheet dispenser is positioned to dispense the packaging sheet so as to form an acute angle between the lateral direction of the packaging sheet and the longitudinal axis of the web roll.

Moreover, the packaging sheet dispenser may be arranged to dispense the packaging sheet to produce an end packaging that has an axial projection on an end of the web roll. The packaging sheet dispenser may be positioned so that the lateral direction of the packaging sheet is substantially parallel to the longitudinal axis of the web roll.

In accordance with the present invention, the device includes a packing press device that includes packing presses. The packing presses are positioned to be able to move parallel to the longitudinal axis of the web roll. Further, the packing presses are associated with end faces of the web roll and are independently positionable.

In accordance with another aspect of the invention, the device further includes at least one sensor device that determines the axial position of the web roll.

In accordance with yet another aspect of the invention, the sensor may be positioned to move parallel to the longitudinal axis of the web roll.

In accordance with another aspect of the invention, each of the packing presses may be associated with one corresponding sensor device, which is moveable in tandem with the associated packing press. Further, the corresponding sensor device may be positioned on the associated packing press.

In accordance with another aspect of the invention, the sensor device includes a first sensor that detects the axial projection of the end packaging and a second sensor. The first sensor may be composed of a light barrier. Moreover, the second sensor may be composed of a sensor to detecting the position of the packing press relative to the associated face of the web roll. Alternatively, the second sensor may also be composed of a pressure sensor or a tactile sensor.

In accordance with another aspect of the invention, the device may further include a folding device to act on the axial projection of the end packaging. The folding device may be positioned for movement parallel to the longitudinal axis and may further include a position signaling device.

Another way to state the invention is a packaging device, for packaging a web roll, having a longitudinal axis. The packaging device includes a packaging sheet dispenser positioned to move parallel to the longitudinal axis and pivotally mounted to dispense a packaging sheet in a helical path around the web roll. The dispensing may form an acute angle between the lateral direction of the packaging sheet and the longitudinal axis of the web roll. The packaging sheet dispenser may dispense the packaging sheet to form an end packaging, including an axial projection.

The device may further include a packing press device that includes at least one packing press that is positioned to move parallel to the longitudinal axis and that is associated with at least one face of the web roll.

In accordance with another aspect of the invention, the packing press may further include two packing presses that are independently positionable.

In accordance with another aspect of the invention, the packaging sheet dispenser forms the end packaging by dispensing the packaging sheet onto an end of the web roll when the lateral direction of the packaging sheet is substantially parallel to the longitudinal axis of the device.

In accordance with yet another aspect of the invention the device may further include at least one sensor device that determines the position of the web roll.

In accordance with another aspect of the invention, at least one sensor device may be composed of at least one light sensor. Further, the sensor device may be composed of at least one tactile sensor or at least one pressure sensor.

In accordance with another aspect of the invention, the sensor device may include a first and a second sensor. The first sensor may be composed of a light sensor and the second sensor may be composed of a tactile sensor.

The present invention may be directed to a method for packaging a web roll with a packaging sheet helically wrapped around the web roll. The method may include forming an end packaging at a first end of the web roll that includes an axial projection, axially moving a packing plate toward the first end of the web roll, sensing the axial projection of the end packaging of the web roll, detecting placement of the packing plate relative to the axial projection and pressing the packing plate against the first end of the web roll.

In accordance with another aspect of the invention, the method may further include positioning an outer face cover against the packing plate, applying glue to the outer face cover and mounting the outer face cover onto the first end of the web roll.

In accordance with another aspect of the invention, when the axial projection is sensed, the method may include reducing the axial movement of the packing plate.

When the placement of the packing plate is detected, the method may further include stopping the axial movement of the packing plate.

The method may further include forming a second end packaging on a second end of the web roll that includes a second axial projection. The second end of the web roll is located opposite the first end of the web roll. The method may further include axially and independently moving a second packing plate toward the second end of the web roll, independently sensing the second axial projection of the second end packaging of the web roll, independently detecting placement of the second packing plate relative to the second axial projection and independently pressing the second packing plate against the second end of the web roll.

The method may further include positioning a second outer face cover against the second packing plate, applying glue to the second outer face cover, and mounting the second outer face cover onto the second end of the web roll.

When the second axial projection is sensed, the method may further include reducing the axial movement of the second packing plate.

Further, when the placement of the second packing plate is detected, the method may further include stopping the axial movement of the second packing plate.

It is understood that the features discussed above and below may be used, not only in the combinations given, but also in other combinations or alone, without departing from the scope of the invention.

Other useful embodiments and advantages of the present invention may be ascertained by reviewing the present disclosure and the accompanying drawings.

BRIEF DESCRIPTION OF THE DRAWINGS

The invention will be better understood by referring to the description which follows with reference to the drawing, which illustrates by way of non-limiting example, embodiments of the invention, wherein.

DETAILED DESCRIPTION OF THE DRAWINGS

Figure 1:
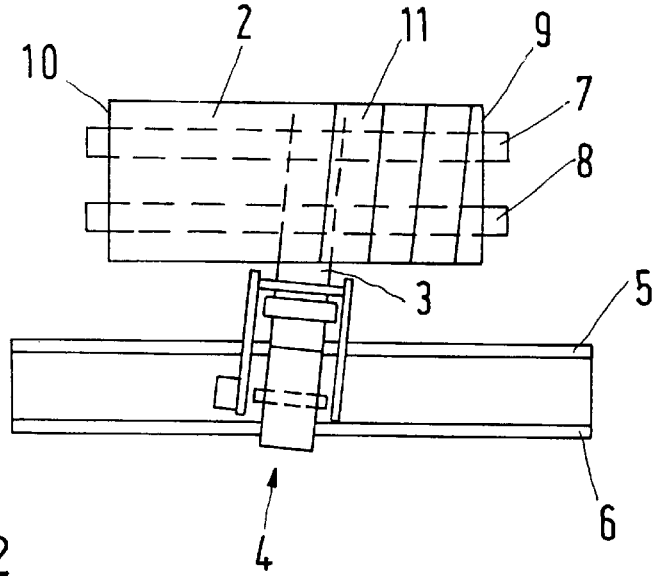
FIG. 1 is a schematic top view diagram showing the production of a circumferential packaging of a web roll.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice The packaging of a web roll 2 is illustrated schematically in FIG. 1, FIG. 2 and FIG. 3. The web roll 2 is typically a relatively large formation, having an axial length of up to 3.8 m or larger. The lower limit of the axial length is in the vicinity of 0.5 m. The diameter of the web roll 2 may be anywhere in the range of about 9.5 meters (m) to about 2.5 m. The web roll 2 is packaged with a substantially smaller packaging sheet 3, which is dispensed from a packaging sheet dispenser 4. The packaging sheet dispenser 4 can be moved parallel to the axial direction of the web roll on tracks 5, 6. The packaging sheet dispenser 4 may also be pivoted from one position, which is at a right angle to the tracks 5, 6, to other positions, in which, as shown in FIG. 1, the packaging sheet dispenser 4 forms an acute angle with the tracks 5, 6. Accordingly, the packaging sheet dispenser 4 dispenses the packaging sheet 3 at the corresponding acute angle. When the packaging sheet 3 becomes wrapped around the web roll 2, a helical body packaging 11 results. The helical body packaging 11 substantially extends along the entire axial length of the web roll 2. The web roll 2 is able to be wrapped because it is rotated on carrier rolls 7, 8, one of which driven by a motor (not shown). Further, the packaging sheet 3 can project or extend over the faces 9, 10 of the web roll 2.

Figure 2:
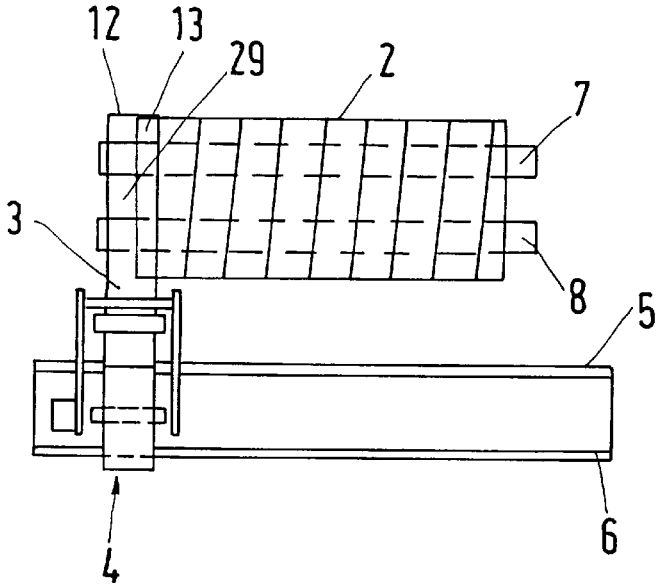
FIG. 2 is a schematic top view diagram showing the production of a circumferential packaging of a web roll.
Figure 3:
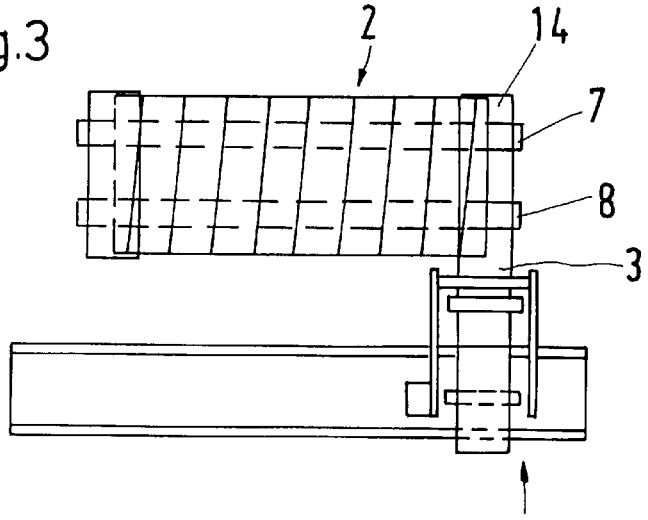
FIG. 3 is a schematic top view diagram showing the production of a circumferential packaging of a web roll.

When the packaging sheet dispenser 4 has completed the body packaging 11, that is, has wound the packaging sheet 3 in a helical line from one end of the web roll to the other, the packaging sheet dispenser 4 is located, as shown in FIG. 2, at the left end of the web roll 2. Further, as shown in FIG. 2, the packaging sheet dispenser 4 is then realigned at a right angle to the tracks 5, 6. The packaging sheet 3 is then wrapped around the web roll 2 to create an axial projection 12, resulting in an end packaging 13. After the packaging sheet dispenser 4 has completed the body packaging, and before the axial projection 12 is created (s shown in FIG. 2), the packaging sheet 3 is severed. Further, After the end packaging 13 is formed, the packaging sheet 3 is again severed. After this second severing, the packaging sheet dispenser 4 moves to the other axial end of the web roll 2, as shown in FIG. 3, and produces a similar end packaging 14, which also includes an axial projection.

It has been observed that the web roll 2 migrates axially while the body packaging 11 is being produced. The web roll 2 migrates in the direction of, or towards, the larger diameter of the web roll 2 (after it is wrapped). In FIG. 1, the direction of migration is to the right. This migration can be estimated at approximately 1 to 2 cm per meter length of the web roll 2. The migration, moreover, leads to problems with respect to the placement of the face covers. The placement of the face covers will explained below in connection with FIG. 4, which shows, in greater detail, a device for packaging the web roll 2.

Figure 4:
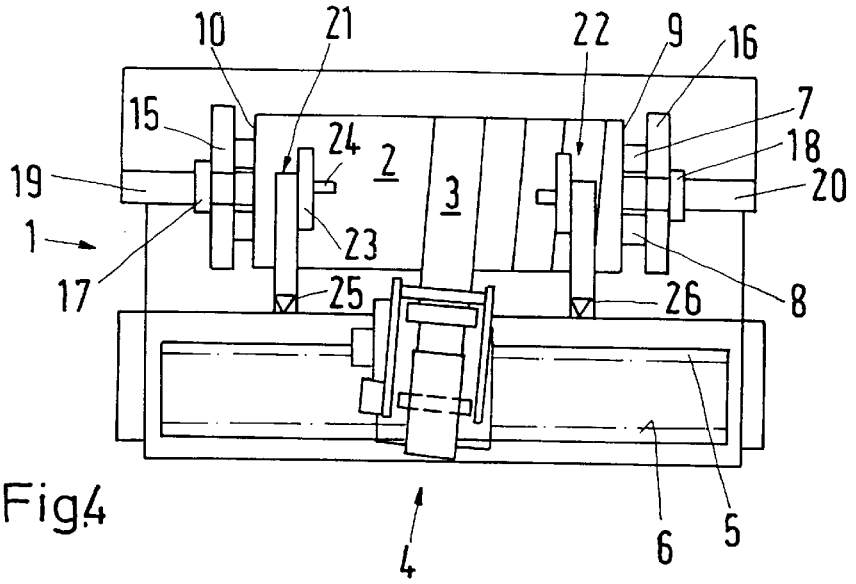
FIG. 4 is a schematic top view diagram of a device for packaging.

As shown in FIG. 4, in addition to the packaging sheet dispenser 4, the packing presses 15, 16 are shown adjacent the respective face 10, 9 of the web roll 2. Each packing press includes a motor-drive 17, 18 to move the packing presses 15, 16 in an axial direction on a track 19, 20. The motor-drive 17, 18, may also be designed to be a piston-cylinder arrangement, which may be positioned between the respective packing press 15, 16 and a frame (not shown) of the device 1. The motor-drives 17, 18 operate independently of each other.

Further, a folding device 21, 22 is provided for each face 9, 10 of the web roll 2. Each folding device 21, 22 may also be moved in the axial direction. Each folding device 21, 22, includes a conventional impeller wheel 23 and an axis extension 24. The axis extension 24 is coupled to the circumference of the web roll 2. The impeller wheel 23 rotates along the rotating web roll 2, thereby wrapping the axial projection 12 of the end packaging 13 on the face 10 of the web roll 2. The same wrapping takes place on the other face 9.

It is noteworthy to mention an unusual feature here. Specifically, each folding device 21, 22 includes a position signally device 25, 26, which can determine the axial location of the folding device 21, 22.

Figure 5:
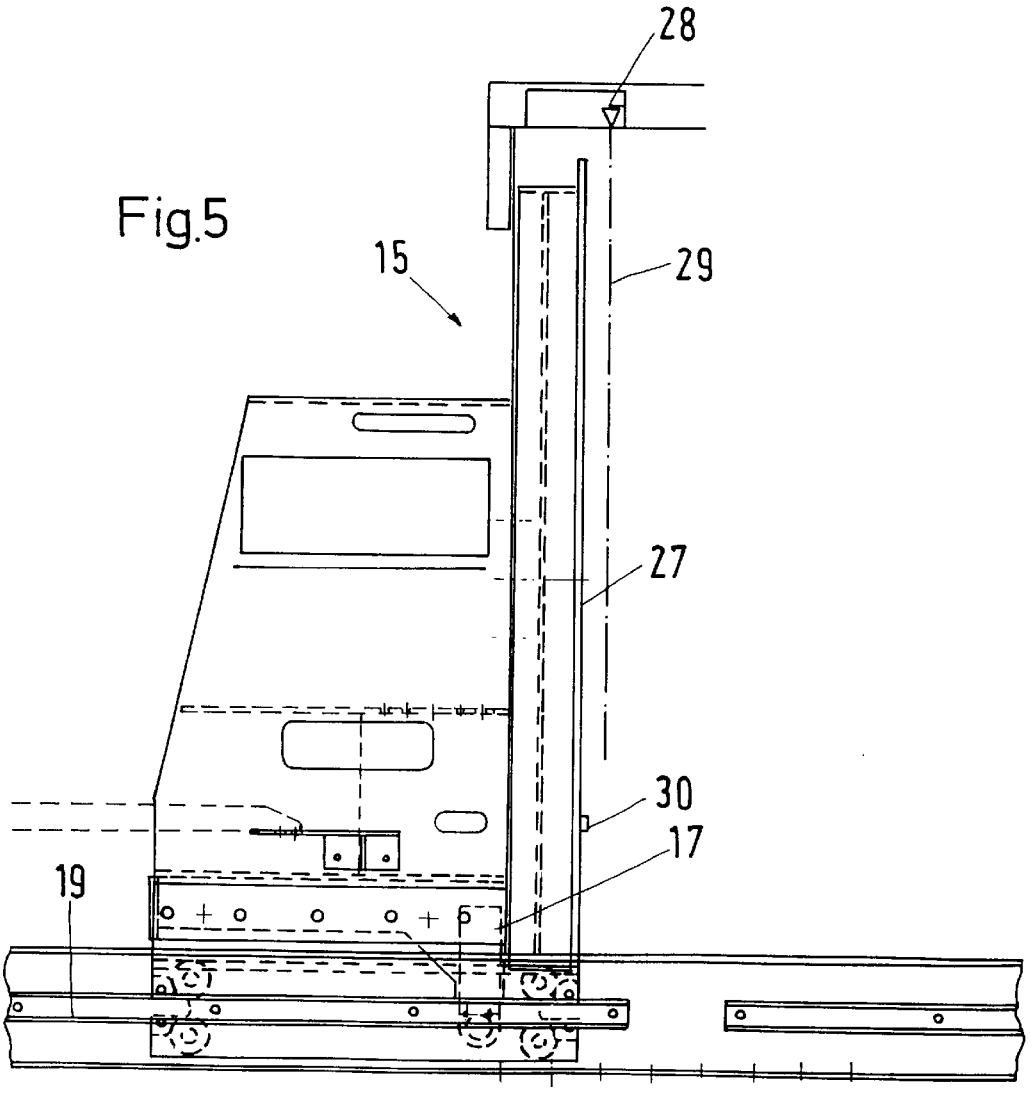
FIG. 5 is a schematic side view diagram of a packing press.

FIG. 5 shows an enlargement of the left packing press 15. The right packing press 16 (not shown) is a corresponding mirror image to the left packing press 15 and the explanations and discussion with respect to the left packing press 15 apply accordingly to the right packing press 16. The packing press 15 includes a press plate 27 on which an outer face cover (not shown) is secured. The press plate 27 may be heated by using outer face covers that include hot glue. The press plate 27 may be moved toward the face 10 of the web roll 2 until the outer face cover, and thus the press plate 27, are in place on the face 10 of the web roll 2. The outer face cover is then glued onto the face, or, rather, onto the wrapped projection 12 of the end packaging 13.

The web roll 2 that has been equipped or provided with the circumferential packaging is no longer positioned axially in the center. Rather, the web roll 2 may be positioned somewhat off-center, with differing distances from the two packing presses 15, 16. The movement of each packing press 15, 16, can be controlled independently of the movement of the other packing press. The packing press 15 exhibits a first sensor 28 that is designed, for this purpose, to be a light barrier. It is possible to have the light barrier work with reflection of light. When the light barrier of the first sensor 28 is interrupted, that indicates that some object may be found in the light beam 29 of the first sensor 28. If the operation has proceeded correctly, the object that interferes with the ability of the light sensor 28 to detect the light beam 29, is the axial projection 12 of the end packaging 13. The axial projection 12 is still a small distance from the face 10 of the web roll 2, even when the web roll 2 is wrapped on this face 10. The stiffness and the inherent tension of the packing paper being used as the packaging sheet 3, makes such a spreading practically unavoidable. Because the first sensor 28 is positioned a small distance in front of the press plate 27, the first sensor 28 determines whether the packing press 15 is approaching the face 10 of the web roll 2. Thus, one can drive the packing press 15 at a relatively greater speed, because there is still sufficient space to serve as "braking distance."

A second sensor 30 is also provided which is designed as a tactile sensor. The second sensor 30 includes a slide lug or ram that protrudes out from the press plate 27. The second sensor 30 is pushed in when it contacts or is placed on the face 10 of the web roll 2, which may, for example, trigger an end-position switch (not shown). As soon as the second sensor 30 determines the placement of the press plate 27 on the face 10 of the web roll 2, all movement toward the web roll 2 ceases. It is now possible to control the two packing presses 15, 16 so that the two packing presses 15, 16 are moved independently of each other until the first sensor 28 detects their approach to the web roll 2. Both packing presses 15, 16 are then carefully moved further until they each are in place at the respective faces 9, 10, at which time the packing presses 15, 16 are stopped. When the axial projection 12,14 has been reached, there is no guarantee that both packing presses 15, 16 will be exactly the same distance to the faces 9, 10. However, the result is a sufficiently good approach.

It is possible, according to the invention, to gather the required information by using the position signaling devices 25, 26 of the folding devices 21, 22 instead of, or in addition to, the first sensor 28.

Further, instead of having the second sensor 30 protrude out of the press plate 27, the second sensor 30 could also be designed as a pressure sensor, which is activated when a corresponding counterpressure is applied to the press plate by the face 10. A pressure sensor can also be stored in the motor-drive strand. Alternatively, other sensors could be used, such as, for example, an electricity meter if an electric motor is being used. The placement of the packing press on the face is indicated by a sudden, dramatic increase in the current, as detected by the electric motor.

The embodiments shown and described are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

In fact, although the invention has been described herein with reference to particular means, materials, methods and embodiments, the invention is not intended to be limited to the particulars disclosed herein; rather, the invention extends to all functionally equivalent structures, methods and uses, such as are within the scope of the appended claims.

What is claimed:

1. A device for packaging a web roll, having a longitudinal axis, with a packaging sheet comprising:

a packaging sheet dispenser dispensing the packaging sheet to produce a body packaging by dispensing on at least a portion of a longitudinal extent of the web roll, the packaging sheet dispenser positioned to dispense the packaging sheet to form an acute angle between a lateral direction of the packaging sheet and the longitudinal axis, the packaging sheet dispenser arranged to dispense the packaging sheet to produce an end packaging having an axial projection on an end of the web roll, the packaging sheet dispenser positioned so that the lateral direction of the packaging sheet is substantially parallel to the longitudinal axis;

a packing press device including packing presses positioned for movement parallel to the longitudinal axis; and the packing presses being associated with end faces of the web roll and being independently positionable.

2. The device according to claim 1, further comprising at least one sensor device that determines an axial position of the web roll.

3. The device according to claim 2, the at least one sensor device being positioned for movement parallel to the longitudinal axis of the device.

4. The device according to claim 2, each of the packing presses being associated with a corresponding one of the at least one sensor device, the corresponding one of the at least one sensor device being moveable in tandem with an associated packing press.

5. The device according to claim 4, the corresponding one sensor device being positioned on the associated packing press.

6. The device according to claim 2, the at least one sensor device comprising a first sensor detecting the axial projection of the end packaging and a second sensor.

7. The device according to claim 6, the first sensor being composed of a light barrier.

8. The device according to claim 6, the second sensor being composed of a sensor detecting the position of the packing press relative to the associated face of the web roll.

9. The device according to claim 8, the second sensor being composed of a pressure sensor.

10. The device according to claim 8, the second sensor being composed of a tactile sensor.

11. The device according to claim 2, further comprising a folding device acting on the axial projection of the end packaging and positioned for movement parallel to the longitudinal axis, the folding device including a position signaling device.

12. The device according to claim 1, further comprising:

a sensor associated with each packing press adapted to detect an approach of the packing press to the associated end face.

13. The packaging device according to claim 12, the sensor being coupled to move with the associated packing press.

14. A packaging device, for packaging a web roll, having a longitudinal axis, comprising:

a packaging sheet dispenser positioned to move parallel to the longitudinal axis and pivotally mounted to dispense a packaging sheet in a helical path around the web roll, the dispensing forming an acute angle between the lateral direction of the packaging sheet and the longitudinal axis, the packaging sheet dispenser dispensing the packaging sheet to form an end packaging including an axial projection;

a packing press device including at least two packing presses which are independently positionable for movement parallel to the longitudinal axis and which are associated with opposite faces of the web roll.

15. The device according to claim 14, further comprising a sensor device to determine the position of the web roll.

16. The device according to claim 15, the sensor device being composed of at least one light sensor.

17. The device according to claim 15, the at least one sensor device being composed of at least one tactile sensor.

18. The device according to claim 15, the sensor device being composed of at least one pressure sensor.

19. The device according to claim 15, the sensor device comprising a first and a second sensor.

20. The device according to claim 19, the first sensor being composed of a light sensor and the second sensor being composed of a tactile sensor.

21. The device according to claim 14, the at least one packing press comprising two packing presses that are independently positionable.

22. The device according to claim 14, the packaging sheet dispenser forming the end packaging by dispensing the packaging sheet onto an end of the web roll when the lateral direction of the packaging sheet is substantially parallel to the longitudinal axis.

23. The device according to claim 14, further comprising:

a sensor associated with the at least one packing press adapted to detect the approach of the at least one packing press to the at least one face.

24. The packaging device according to claim 23, the sensor being coupled to move with the associated packing press.

25. A method for packaging a web roll with a packaging sheet helically wrapped around the web roll comprising:

forming an end packaging at a first end of the web roll that includes an axial projection;

axially moving a packing plate toward the first end of the web roll;

sensing the axial projection of the end packaging of the web roll;

detecting placement of the packing plate relative to the axial projection; and pressing the packing plate against the first end of the web roll.

26. The method according to claim 25, further comprising:

forming a second end packaging on a second end of the web roll that includes a second axial projection, the second end of the web roll located opposite the first end of the web roll;

axially and independently moving a second packing plate toward the second end of the web roll;

independently sensing the second axial projection of the second end packaging of the web roll;

independently detecting placement of the second packing plate relative to the second axial projection; and independently pressing the second packing plate against the second end of the web roll.

27. The method according to claim 26, wherein when the second axial projection is sensed, the method further comprising:

reducing the axial movement of the second packing plate.

28. The method according to claim 26, wherein when the placement of the second packing plate is detected, the method further comprising:

stopping the axial movement of the second packing plate.

29. The method according to claim 26, further comprising:

positioning a second outer face cover against the second packing plate;

applying glue to the second outer face cover; and mounting the second outer face cover onto the second end of the web roll.

30. The method according to claim 21, further comprising:

positioning an outer face cover against the packing plate;

applying glue to the outer face cover; and mounting the outer face cover onto the first end of the web roll.

31. The method according to claim 25, wherein when the axial projection is sensed, the method further comprising:

reducing the axial movement of the packing plate.

32. The method according to claim 25, wherein when the placement of the packing plate is detected, the method further comprising:

stopping the axial movement of the packing plate.

* * * * *